US005506594A

United States Patent [19]

Baker

[11] Patent Number: 5,506,594

[45] Date of Patent: Apr. 9, 1996

[54] HELICALLY SHAPED CIRCULARLY POLARIZING ANTENNA

[75] Inventor: Robert S. Baker, Harrison, Me.

[73] Assignee: Howell Laboratories, Inc., Bridgton, Me.

[21] Appl. No.: 223,279

[22] Filed: Apr. 5, 1994

[51] Int. Cl.$^6$ ..... H01Q 1/12

[52] U.S. Cl. ..... 343/891; 343/890; 343/742

[58] Field of Search ..... 343/891, 890, 343/895, 892, 741, 743, 742, 893, 850, 855; H01Q 1/12, 11/12

[56] References Cited

U.S. PATENT DOCUMENTS 2,289,856 7/1942 Alford ..... 343/704
2,306,113 12/1942 Alford ..... 343/890
4,031,536 6/1977 Alford ..... 343/890
4,223,315 9/1980 Alford ..... 343/890

*Primary Examiner*—Donald T. Hajec
*Assistant Examiner*—Hoanganh Le
*Attorney, Agent, or Firm*—Samuels, Gauthier & Stevens

[57] ABSTRACT

A broadcast antenna that generates circularly polarized waves and comprises a pair of conducting arms having portions forming a normal mode helix with one arm interrupted by an insulator to permit the connection of an internal feed line.

18 Claims, 7 Drawing Sheets

HELICALLY SHAPED CIRCULARLY POLARIZING ANTENNA

FIELD OF THE INVENTION

The invention relates to antennas and particularly to a broadcast antenna that generates a circularly polarized wave.

BACKGROUND AND BRIEF SUMMARY OF THE INVENTION

With broadcast antennas, such as circularly polarized wave antennas, it is always desirable to broadcast over a wide frequency band at a high radiator power level. Also, in some environments, icing of the antennas is inevitable and this icing affects the transmission (tuning) characteristics of the antennas.

It is the object of the invention to broadcast circularly polarized waves over a frequency band wider than typical broadcast antennas, at a per radiator power level higher than typical broadcast antennas, with ice susceptibility in an unprotected bay lower than typical broadcast antennas.

The above and other objects of the invention are attained by an antenna construction including as the basic radiating elements a pair of conducting arms having portions forming a normal mode helix with one arm interrupted by an insulator to permit the connection of an internal feedline. The normal mode helix is a broadband radiator. The bandwidth in this case is enhanced by the large size ($\lambda/39$ diameter) of the conducting arms. This large arm size also allows a larger feedline to fit inside the individual radiator, thereby increasing the power input rating. In a preferred embodiment, in this case at 100 MHz, 40 kW CW would be the input power rating.

Ice susceptibility is reduced by covering the sensitive feed point with an insulator and by spreading out the effect of ice with large diameter conducting arms.

Broadly, my invention, in a preferred embodiment, provides a frequency band of about 3 MHz wide compared to a prior art antenna of 0.5 to 1.0 MHz. Also, the antenna of the invention is 40 kilowatts input power versus 30 kilowatts of the prior art. Further, the feed structure of the antenna is isolated from icing.

BRIEF DESCRIPTION OF THE DRAWING(S)

DESCRIPTION OF THE PREFERRED EMBODIMENT(S)

Figure 1:
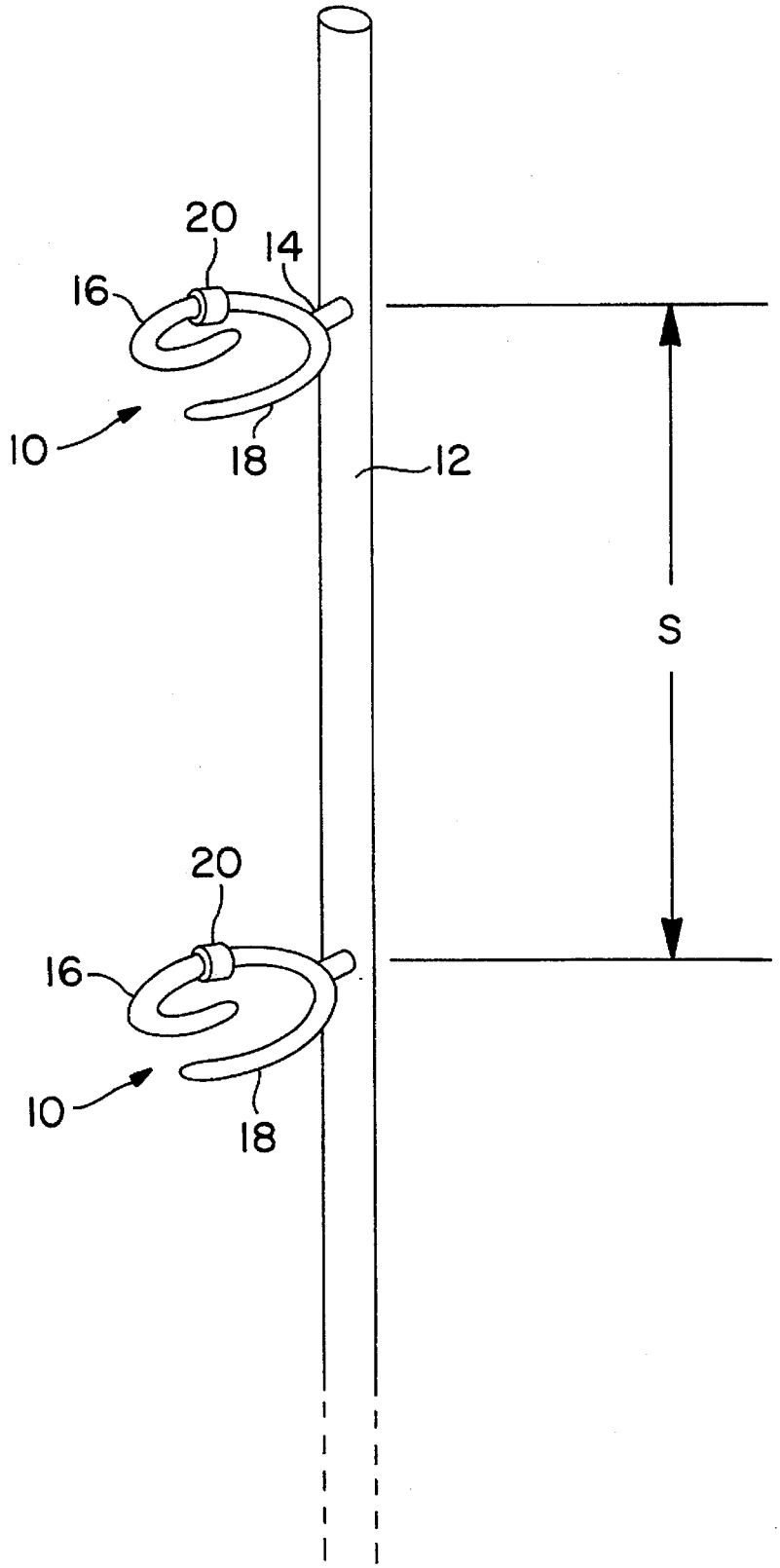
FIG. 1 is a diagrammatic perspective sketch of two bays of a multiple bay antenna in accordance with a preferred embodiment of the invention.
Figure 2:
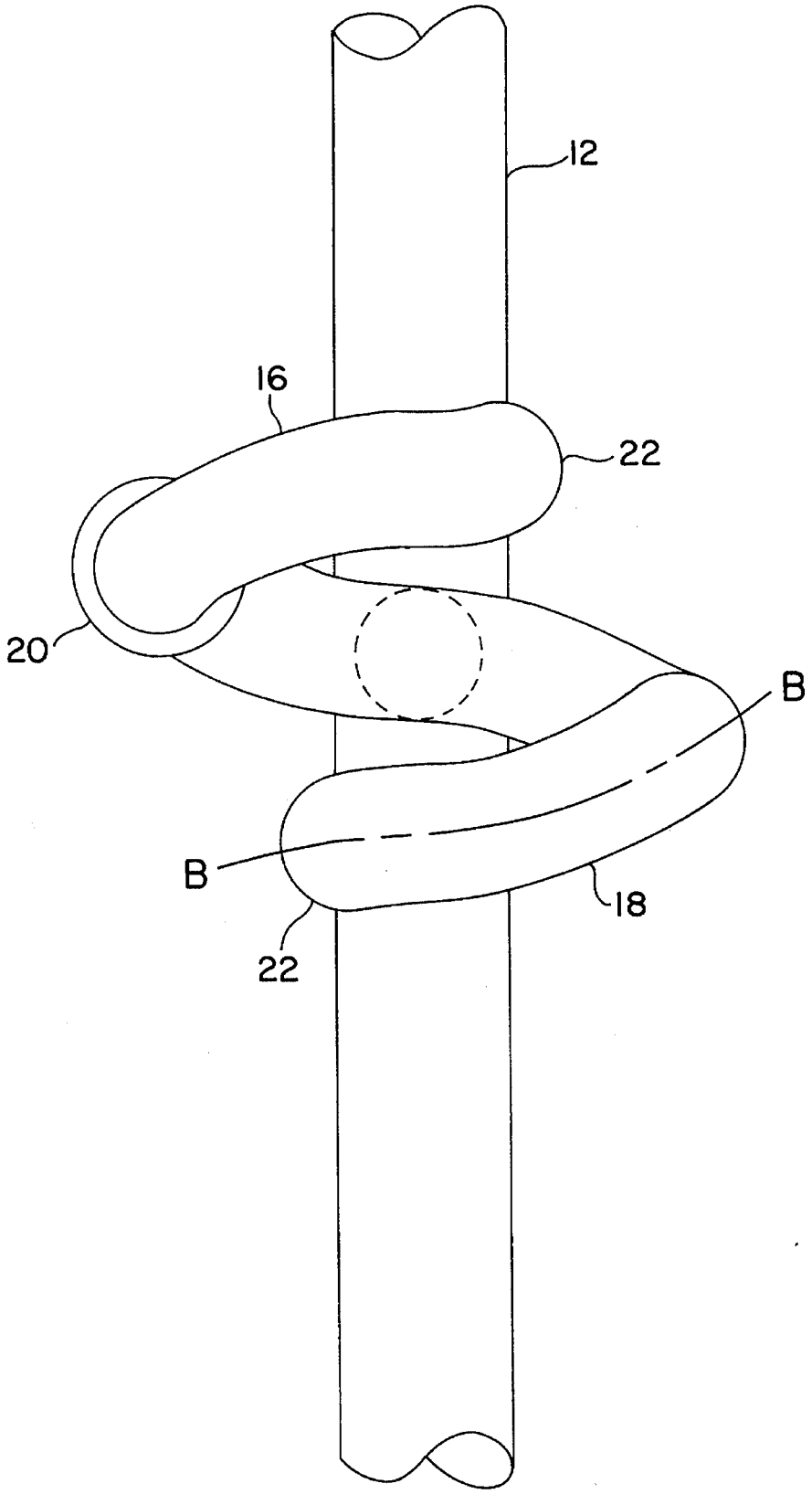
FIG. 2 is a front elevation of a radiator forming one bay of the antenna of FIG. 1.
Figure 3:
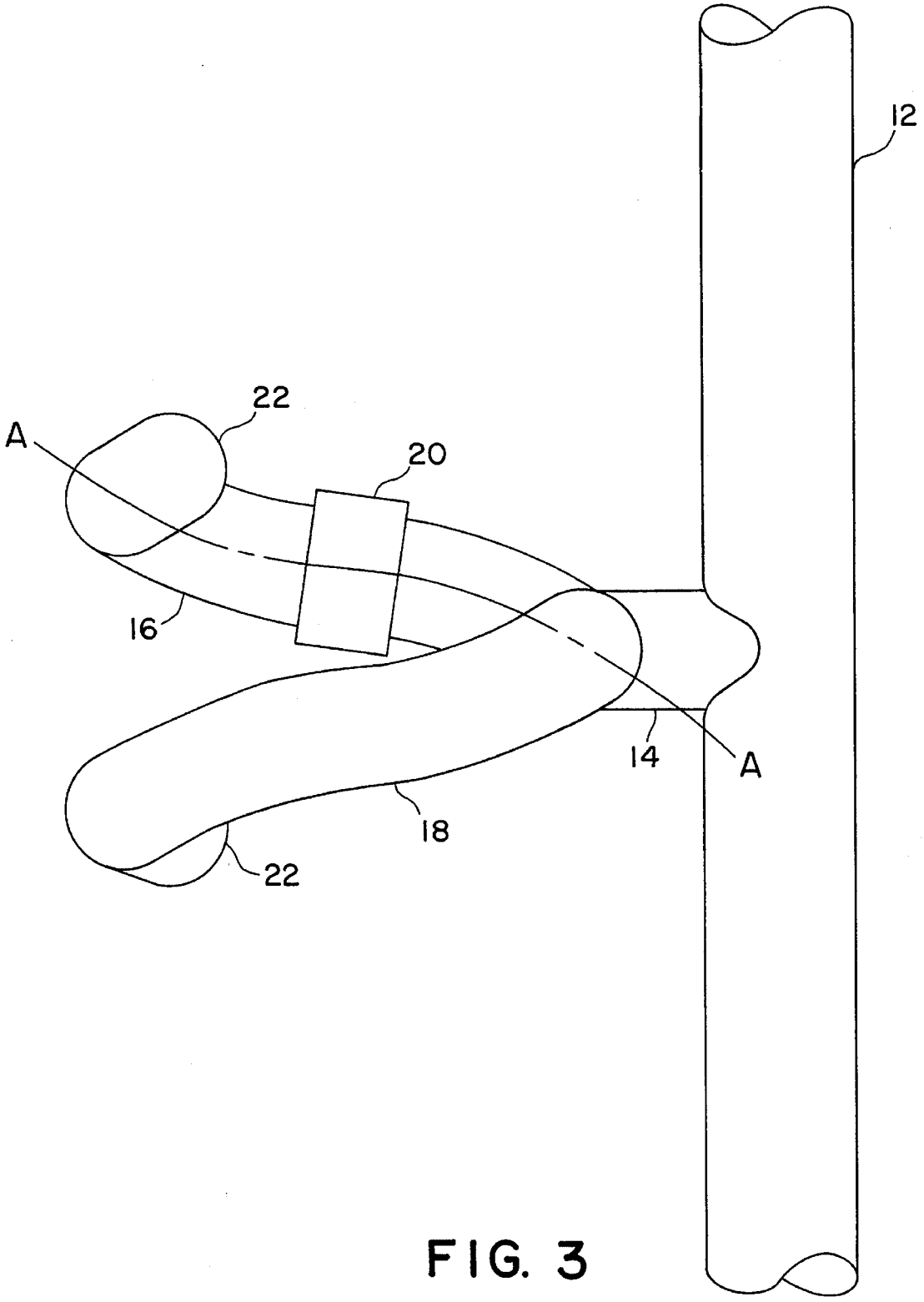
FIG. 3 is a side elevation of the radiator of FIG. 2.
Figure 4:
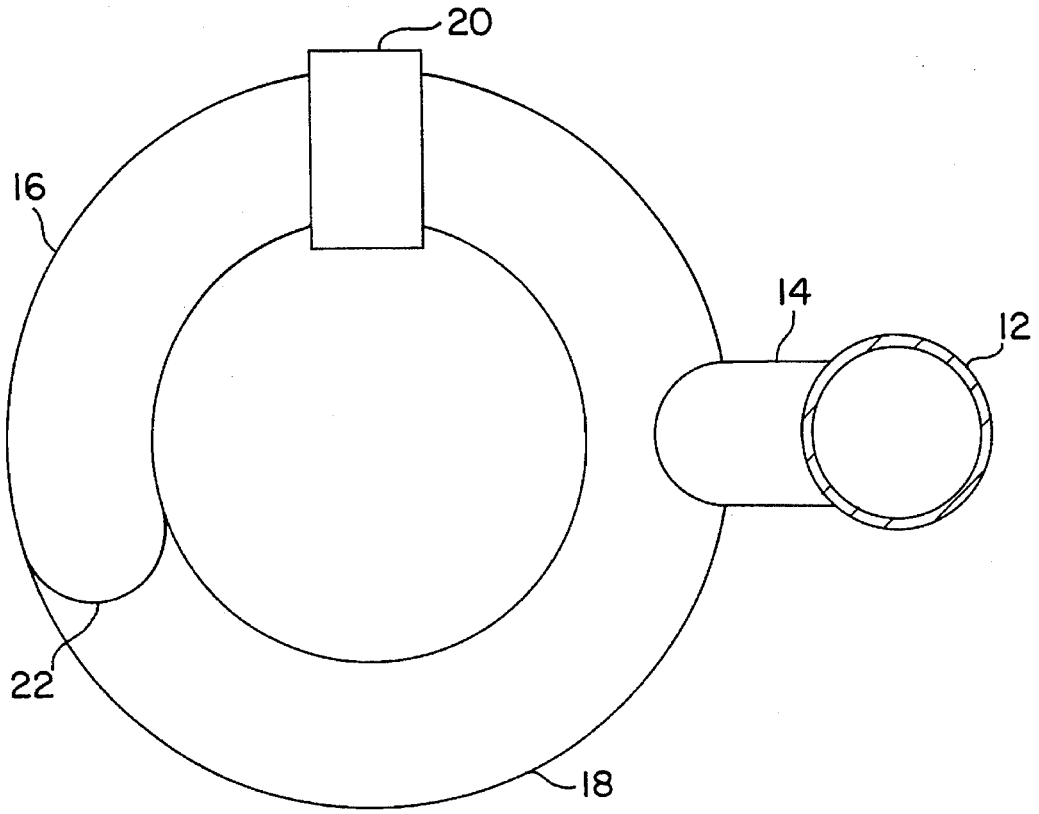
FIG. 4 is a top view of the radiator of FIG. 2.
Figure 5:
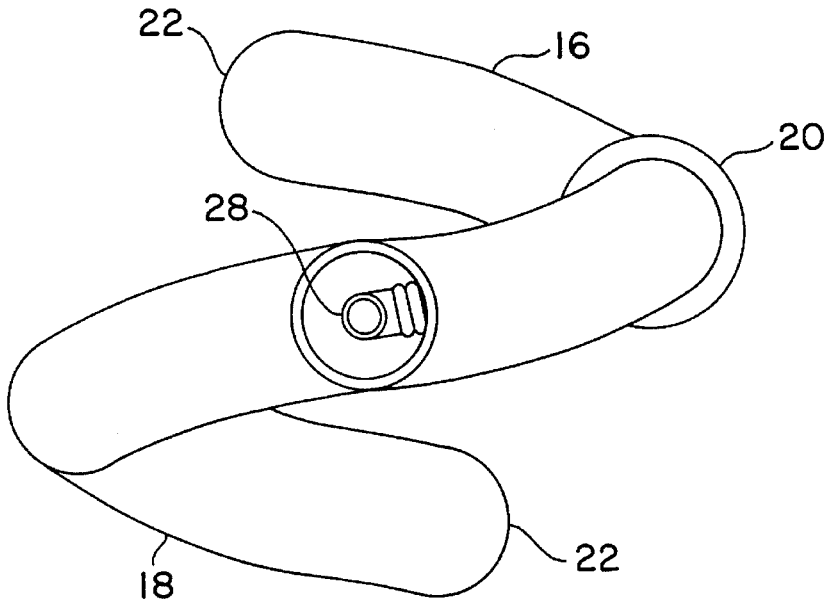
FIG. 5 is back view of the radiator of FIG. 2.

Referring to FIG. 1, a transmitting antenna in accordance with the invention comprises any desired number of bays each formed by a radiator generally designated at 10. The radiators 10 are mounted on a conducting column 12 of any desired form. In practice, the column 12 is preferably a tubular metal feedline having predetermined dimensions selected in accordance with the electrical requirements of the array. Such a feedline can then be connected mechanically by conventional means to masts or towers of various dimensions. Alternatively, the column 12 may constitute both a feedline and a support for the array.

The individual radiators 10 are spaced apart by a distance S, equal to the wavelength of the carrier to be transmitted. Each of the radiators 10 comprise a mounting assembly generally indicated at 14 for mechanically securing the radiator to the column 12 and electrically connecting it to a transmission line such as may be formed by the column 12 and a conductor centrally disposed therein.

Each of the radiators 10 comprise a pair of conducting arms, specifically a driven arm 16 and grounded arm 18, the arms forming a helix with its axis parallel to the column 12. A feed insulator 20 separates the driven arm 16 from the grounded arm 18. The total length of the helix formed by the driven arm 16, the feed insulator 20, and the grounded arm 18 is $\lambda/2$, where $\lambda$ is the wavelength of the carrier to be broadcast. The pitch of the helix formed is within a range of about $\lambda/7$ to $\lambda/20$, and is preferably about $\lambda/10$. The length of the driven arm 16 is about $\lambda/8$. The length of the grounded arm 18 is about $3\lambda/8$ with the feed insulator 20 located at one end. The mounting assembly 16 which also acts as a radio frequency ground is located about $\lambda/8$ from the feed insulator 20 on the outside of the grounded arm 18 and is perpendicular to the axis of the helix.

Figure 6:
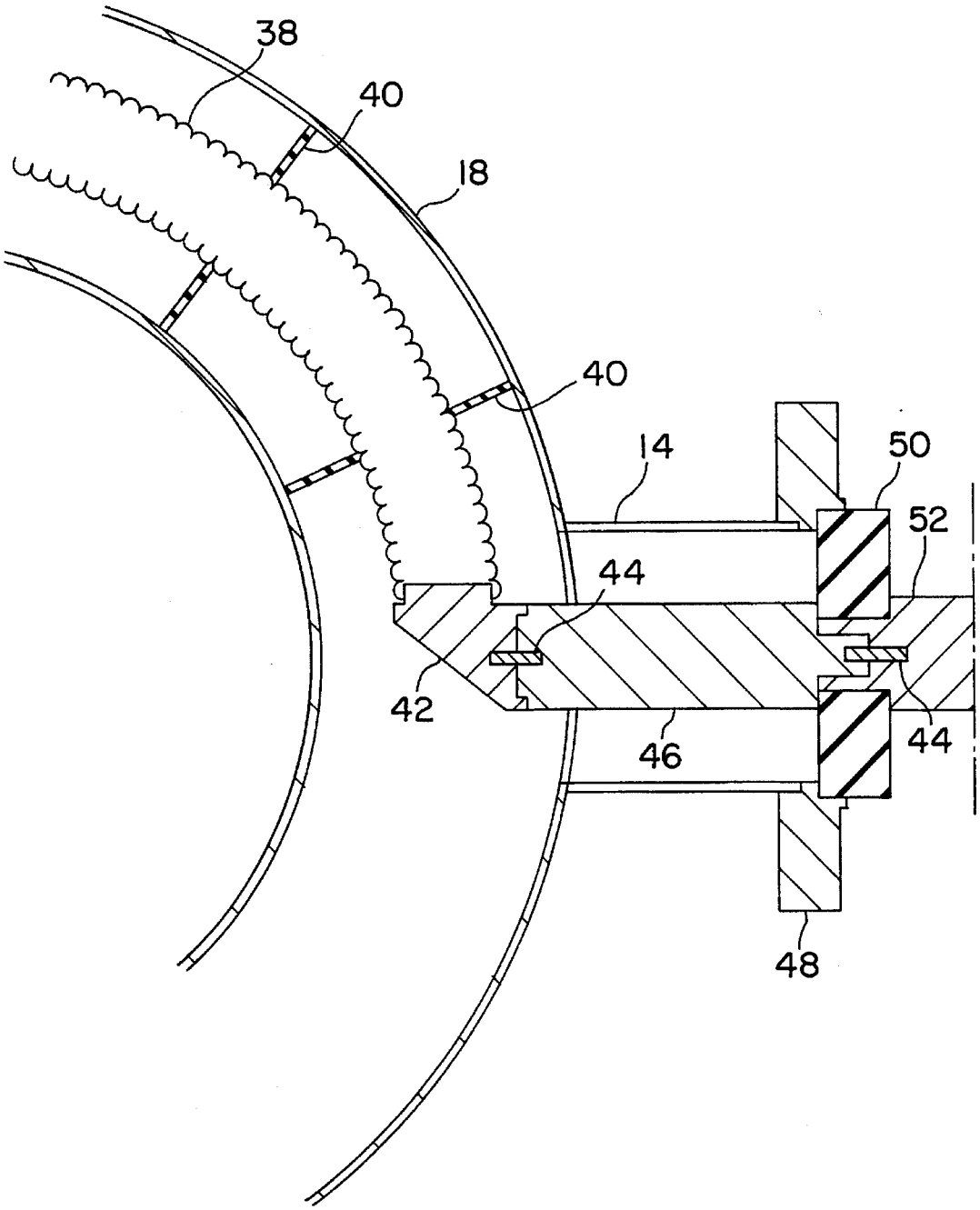
FIG. 6 is an enlarged cross-sectional view of a portion of the apparatus of FIG. 3 taken substantially along the helical centerline A—A in FIG. 3.
Figure 7:
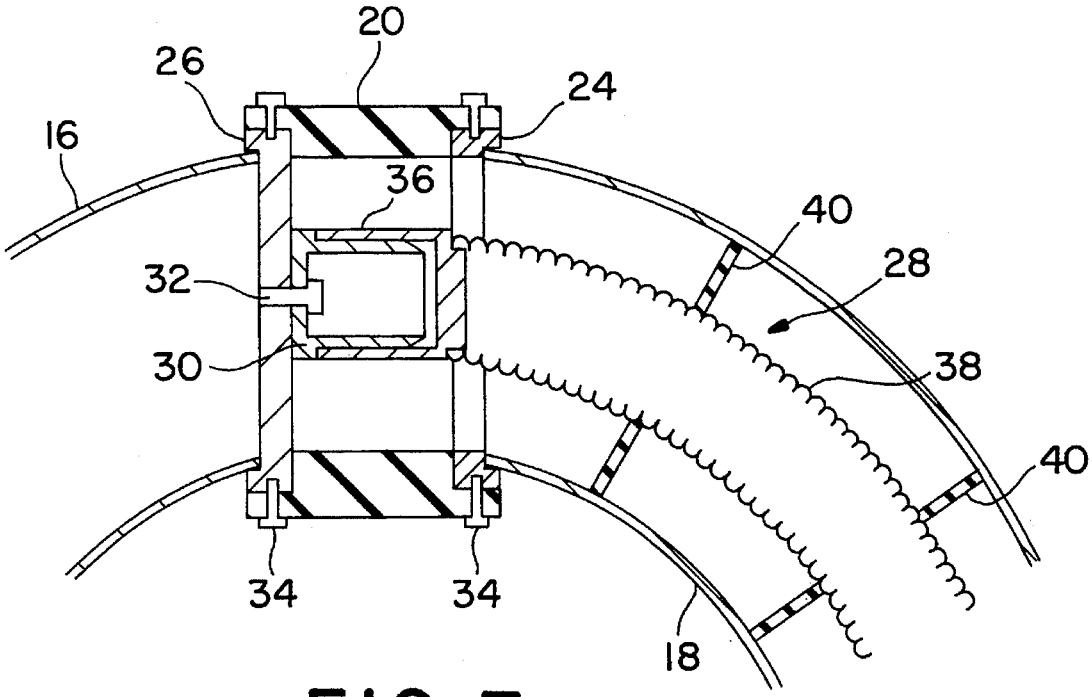
FIG. 7 is an enlarged cross-sectional view of a portion of the apparatus of FIG. 3 taken substantially along the helical centerline A—A in FIG. 3.
Figure 8:
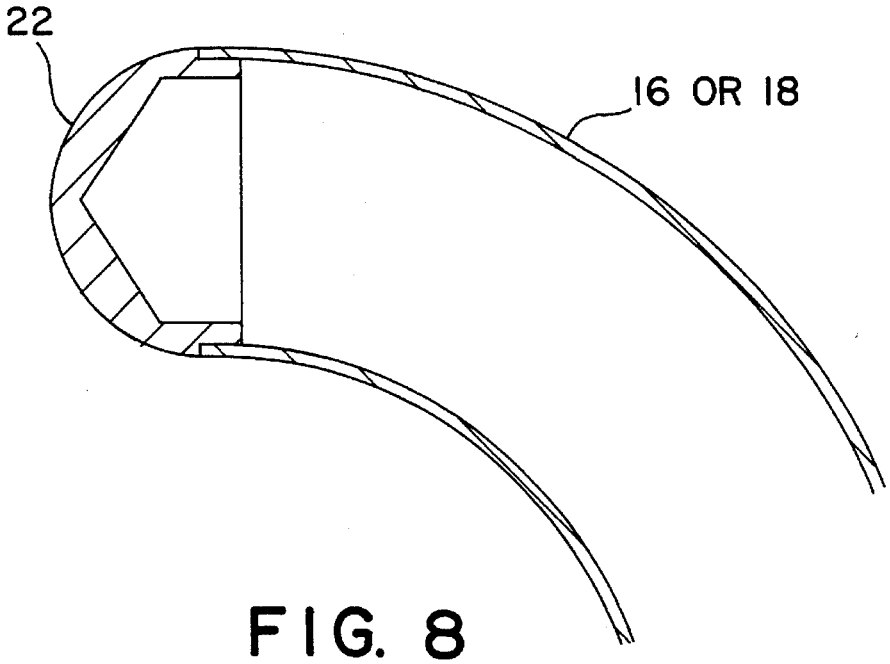
FIG. 8 is an enlarged cross-sectional view of a portion of the apparatus of FIG. 2 taken substantially along the helical centerline B—B in FIG. 2.

Referring to FIGS. 2 through 8, the conducting arms 16 and 18 are formed of tubular metal, preferably copper alloy or the like, of an outside diameter of within a range of about $\lambda/27$ to $\lambda/76$ and is preferably about $\lambda/39$. The free ends of the conducting arms 16 and 18 are terminated in end caps 22, preferably of hemispherical shaped, formed of copper alloy or the like, and joined to the arms 16 and 18 by welding or other conventional metal joining techniques. The end caps 22 may be formed with a hollow recess in it to reduce the weight of the radiator, as shown in FIG. 8.

Referring to FIG. 7, the captured ends of the conducting arms 16 and 18 are terminated in round flanges 24 and 26 formed of copper alloy or the like and joined to the conducting arms 16 and 18 by welding or other conventional metal joining techniques. The flange 24 connected to the grounded arm 18 has a hole in the center the same diameter as the inner diameter of the metal tubing used to form the grounded arm 18 to allow the passage of an inner conductor assembly 28. The inner conductor assembly 28 makes the electrical connection between the driven arm 16 and the feedline 12 by forming a coaxial line with the ground arm 18 and the mounting assembly 14. The flange 26 connected to the driven arm 16 has a threaded hole in the center to allow the attachment of the inner conductor assembly 28 through the use of an EIA style connector 30 or the like and a bolt 32 or any other conventional means. The feed insulator 20 is formed from chlorinated polyvinyl chloride or the like.

The driven arm 16 is attached to the grounded arm 18 by the feed insulator 20 through the use of bolts 34 or any other conventional means.

Connection of the inner conductor assembly 28 to the driven arm 16 is accomplished by a connector cup 36 mechanically secured to the EIA style connector 30 which is attached to the driven arm 16 as previously described. The connector cup 36, formed from copper alloy or other suitable materials, is attached to the flexible tube 38 by silver brazing or other suitable means. The flexible tube 38 is constructed preferably from corrugated copper alloy tube, though any suitable conductive tubing that can be bent to shape will work. The flexible tube 38 comprises the bulk of the inner conductor assembly 28 and is supported by four insulators 40 which are designed using standard techniques to yield minimum VSWR distortion.

As shown in FIG. 6, the input end of the flexible tube is attached to a miter 42 by silver brazing, or other suitable means. The miter 42 is formed from copper alloy or other suitable metal and forms a 90 degree angle in the inner conductor assembly 28. The back side dimension of the miter is derived using standard techniques. A threaded hole in the miter 42 allows a set screw 44 to make the mechanical connection to an input inner 46. The input inner 46, formed from copper alloy or other suitable metal, forms a short piece of coaxial line with the mounting assembly 14 which is constructed from a similar piece of tubing used to form the grounded arm 18. At the end of the mounting assembly 14 is a flange 48 attached by welding or the like, an insulator 50, and a connector 52 mechanically fastened to the input inner 46 by a set screw 44. The design of the flange 48, insulator 50, and connector 52 are all in accordance with standard EIA designs.

While the radiator of the invention can be excited in various ways, it is here shown adapted to be coupled to a coaxial cable. Any other form of transmitting line, such as waveguide or the like could be employed if so desired.

Figure 9:
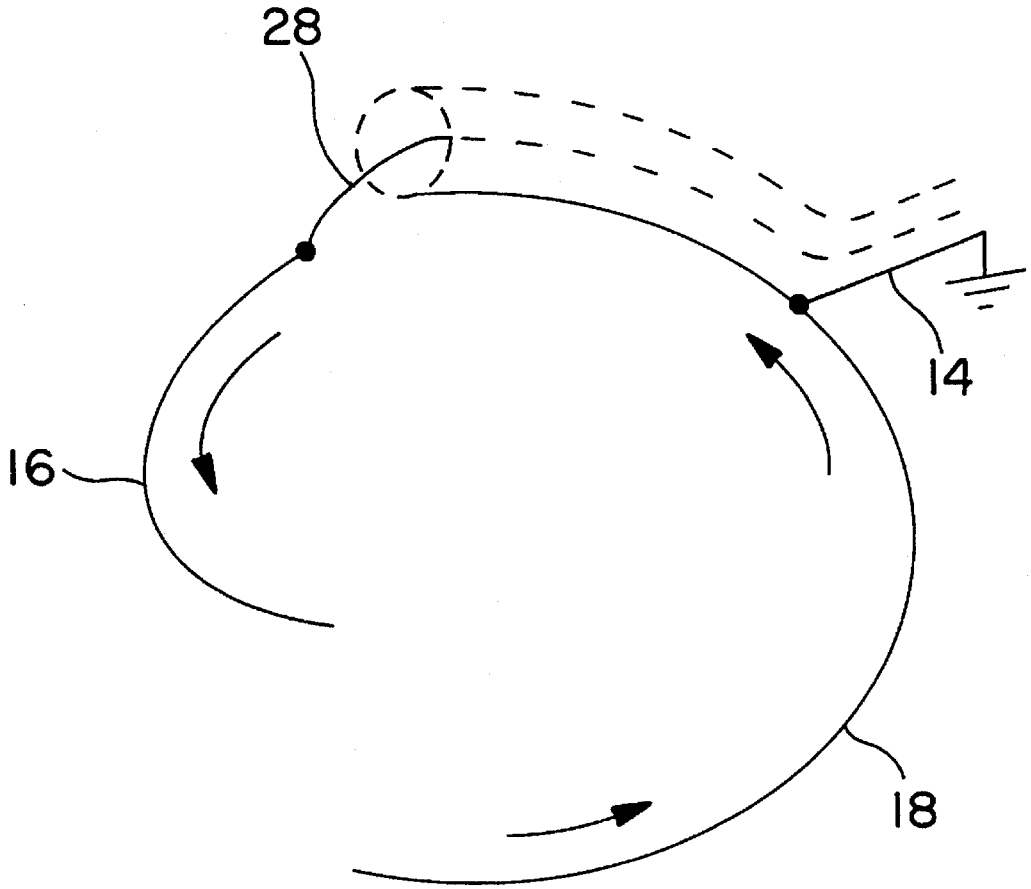
FIG. 9 is a diagrammatic perspective sketch showing the electrical characteristics of the radiator of FIGS. 2 through 8 and illustrating graphically the relationship between the currents in the various elements of the radiator during operation.

The outer conductor of the coaxial cable which may comprise or be connected to the column 12 is mechanically and electrically secured to the flange 48. The inner conductor assembly 28 passes through four insulators and is connected to the driven arm flange 26 which is, in turn, connected to the driven arm 16, thus establishing a current on the outside of the radiator. The electrical circuit formed is best shown in FIG. 9. Also shown in FIG. 9 are the relative currents flowing in the elements of the antenna when it is excited at its resonant frequency.

The radiator, as described, has a ratio of vertically polarized radiation to horizontally polarized radiation of unity. The total power gain per radiator is one, with one half being horizontally polarized gain, and the other half being vertically polarized gain. The total gain of a multiple bay antenna, such as shown in FIG. 1, is essentially equal to the sum of the gains of the individual radiators. Thus, the total gain of the antenna section shown in FIG. 1 would be 2.

The antenna of the invention has a radiation pattern that is essentially uniform in azimuth for both horizontally and vertically polarized components. The power is largely propagated in a horizontal plane, and very little is propagated toward the zenith. Thus, the elevation pattern of both components approximates that of a vertical dipole, and the combined radiation is circularly polarized and primarily horizontally directed. In alternative embodiments the pitch of the arms may be reversed to produce circular polarization in the opposite direction, e.g., left hand circular polarization.

While the apparatus of the invention has been described with respect to the details of a preferred embodiment thereof, many changes and variations will occur to those skilled in the art upon reading my description, and such can be made without departing from the scope of my invention.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. An electromagnetic radiator comprising:

first and second conducting arms separated by an electromagnetic insulator, said arms together forming a normal mode helix, and said first arm including coupling means for attaching said radiator to an antenna mast, said coupling means including first and second mutually insulated electrical conductors extending between the mast and said radiator, said first electrical conductor being in direct electrical communication with said first arm; and internal electrical conductor means for providing direct electrical communication between said second arm and said second electrical conductor of said coupling means, said internal conductor means extending through said electromagnetic insulator and through at least a portion of said first arm to said coupling means such that said first and second arms may be concurrently maintained at different electromagnetic potentials responsive to said electrical conductors of said coupling means being maintained at different electromagnetic potentials.

2. An electromagnetic radiator as claimed in claim 1, wherein said coupling means includes a coaxial electrical conductor such that said first electrical conductor comprises an outer conductor element, and said second electrical conductor comprises an inner conductor element.

3. An electromagnetic radiator as claimed in claim 1, wherein said first conducting arm is maintained at an electrical potential of approximately zero voltage.

4. An electromagnetic radiator as claimed in claim 1, wherein said first and second mutually insulated electrical conductors of said coupling means are in electrical communication respectively with first and second mutually insulated electrical conductors within the antenna mast.

5. An electromagnetic radiator as claimed in claim 4, wherein said first electrical conductor of said coupling means includes an outer surface of said coupling means.

6. An electromagnetic radiator as claimed in claim 4, wherein said first electrical conductor of said antenna mast includes an outer surface of said antenna mast.

7. An electromagnetic radiator as claimed in claim 1, wherein said coupling means is positioned at approximately one half the distance along the length of the helix formed by said radiator.

8. An electromagnetic radiator as claimed in claim 1, wherein said radiator is resonant at a wavelength $\lambda$, and the length of said first conducting arm is approximately $3\lambda/8$ and the length of the second conducting arm is approximately $\lambda/8$ as measured along the path of the helix formed by said radiator.

9. An electromagnetic radiator as claimed in claim 1, wherein said radiator is resonant at a wavelength $\lambda$, and the pitch of the helix formed by said radiator is within a range of about $\lambda/7$ to $\lambda/20$ to produce a ratio of vertically polarized radiation to horizontally polarized radiation other then unity.

10. An electromagnetic radiator as claimed in claim 1, wherein said radiator is resonant at a wavelength $\lambda$, and the pitch of the helix formed by said radiator is about λ/10 to produce a ratio of vertically polarized radiation to horizontally polarized radiation of approximately one.

11. An electromagnetic radiator as claimed in claim 1, wherein said radiator is resonant at a wavelength λ, and the outside diameters of said first and second conducting arms are within a range of about λ/27 to λ/76.

12. An electromagnetic radiator as claimed in claim 1, wherein said radiator is resonant at a wavelength λ, and the outside diameter of said first and second conducting arms are both approximately λ/39.

13. An electromagnetic radiator as claimed in claim 1, wherein the pitch of the helix formed by said radiator is reversed to produce left hand circular polarization.

14. An electromagnetic radiator comprising:

first and second conducting arms each including free and terminal ends thereof, said terminal ends being attached to either side of an electromagnetic insulator, and said first conducting arm including coupling means intermediate of said free and terminal ends for attaching said radiator to an antenna mast; and an internal conductor extending from said coupling means through at least a portion of said first conducting arm to said electromagnetic insulator prior to reaching said terminal end of said second conducting arm, said coupling means including a first conductor in direct electrical communication with said first conducting arm; and a second conductor in direct electrical communication with said internal conductor such that said first and second arms may be concurrently maintained at different electromagnetic potentials responsive to said electrical conductors of said coupling means being maintained at different electromagnetic potentials.

15. An electromagnetic antenna comprising:

an antenna mast including first and second mutually insulated electrical conductors; and a plurality of radiators attached to said mast, each of said radiators comprising:

first and second conducting arms separated by an electromagnetic insulator, said first arm including coupling means for attaching said radiator to said antenna mast, said coupling means including first and second mutually insulated electrical conductors in direct electrical communication respectively with said first and second electrical conductors of said antenna mast;

internal conductor means for providing direct electrical communication between said second conducting arm and said second electrical conductor of said coupling means, said internal conducting means extending through said electromagnetic insulator and through at least a portion of said first conducting arm to said coupling means such that said first and second arms may be concurrently maintained at different electromagnetic potentials responsive to said electrical conductors of said antenna mast being maintained at different electromagnetic potentials.

16. An electromagnetic antenna as claimed in claim 15, wherein said first electrical conductors of said coupling means and said antenna mast are electrically connected together via mechanical engagement.

17. An electromagnetic antenna as claimed in claim 15, wherein said second electrical conductors of said coupling means and said antenna mast are electrically connected together via mechanical engagement.

18. An electromagnetic antenna as claimed in claim 15, wherein each of said first conductor element of said antenna mast, said first conductor element of said coupling means, and said first conducting arm are all maintained at an electrical potential of approximately zero voltage.

* * * * *